US012624688B2

(12) United States Patent
Malyshkin

(10) Patent No.: US 12,624,688 B2
(45) Date of Patent: May 12, 2026

(54) SUMP PUMP SYSTEM AND METHOD FOR OPERATING THEREOF

(71) Applicant: Oleg Malyshkin, Staten Island, NY (US)

(72) Inventor: Oleg Malyshkin, Staten Island, NY (US)

( * ) Notice: Subject to any disclaimer, the term of this patent is extended or adjusted under 35 U.S.C. 154(b) by 143 days.

(21) Appl. No.: 18/637,416

(22) Filed: Apr. 16, 2024

(65) Prior Publication Data

US 2025/0320856 A1 Oct. 16, 2025

(51) Int. Cl.
*F04B 23/08* (2006.01)
*E02D 19/00* (2006.01)

(52) U.S. Cl.
CPC ..... *F04B 23/08* (2013.01); *E02D 19/00* (2013.01)

(58) Field of Classification Search
None
See application file for complete search history.

(56) References Cited

U.S. PATENT DOCUMENTS 2,643,732 A * 6/1953 Keen ..... A47L 7/0019 55/303
4,080,104 A * 3/1978 Brown, Jr. ..... A47L 7/0028 417/40
4,179,768 A * 12/1979 Sawyer ..... A47L 7/0042 15/352
4,371,383 A * 2/1983 Rost ..... B01D 19/0047 96/418
4,378,611 A * 4/1983 Ninehouser ..... A47L 11/4083 417/40
4,939,809 A * 7/1990 Park ..... A47L 7/0028 15/328
4,976,850 A * 12/1990 Kulitz ..... E04H 4/1636 210/232
5,096,598 A * 3/1992 Pecen ..... C04B 33/30 210/114
8,516,650 B2 * 8/2013 Beers ..... A47L 9/2889 15/319
10,557,480 B1 * 2/2020 Gharakhanian ..... F04B 35/06
11,877,714 B2 * 1/2024 Friedrich ..... A47L 9/2868
12,313,056 B2 * 5/2025 Gharakhanian ..... F04B 53/005
2015/0147953 A1 * 5/2015 Park ..... F24F 11/0001 454/256
2024/0209848 A1 * 6/2024 Gharakhanian ..... F04F 5/10

* cited by examiner

*Primary Examiner* — Dominick L Plakkoottam
*Assistant Examiner* — Geoffrey S Lee
(74) *Attorney, Agent, or Firm* — Boris Leschinsky

(57) ABSTRACT

A sump pump system includes a water intake port, a water accumulation reservoir, a water discharge pump, and a vacuum pump. The reservoir includes a first port, a second port connected to the water intake port and positioned above the first port, and a third port positioned above the second port. The water discharge pump is connected to the first port to empty the water accumulation reservoir. The vacuum pump is configured to decrease air pressure in the water accumulation reservoir below atmospheric pressure on a scheduled or timed basis. Low pressure forces the water to flow from the water intake port into the water accumulation reservoir. When no water is present, it causes active air ventilation in the vicinity of the water intake port, which improves a state of dryness and eliminates any small amounts of water that may still be present.

5 Claims, 5 Drawing Sheets

SUMP PUMP SYSTEM AND METHOD FOR OPERATING THEREOF

BACKGROUND

Without limiting the scope of the invention, its background is described in connection with sump pumps. More particularly, the invention describes an automatic sump pump that can be used in a variety of circumstances.

Sump pumps are predominantly employed in areas susceptible to water accumulation and flooding, serving as a critical component in safeguarding these environments. Basements, being the lowest points in a building, are the most common sites for sump pump installations to prevent water ingress and the consequent damage. Similarly, crawl spaces, which are close to ground level, also benefit from sump pumps to deter moisture buildup, mold growth, and structural deterioration. Garages, especially those that are below grade or have flat surfaces, use sump pumps to avoid water damage to vehicles and stored items. In commercial settings, such as buildings with extensive basement areas or subterranean levels, sump pumps are essential for water management and flood prevention. They are equally vital in regions with high water tables or during heavy rainfall, where they prevent groundwater from encroaching into buildings. Moreover, in industrial and agricultural contexts, sump pumps play a key role in controlling water levels, thereby protecting equipment, processes, and livestock from the adverse effects of excessive water.

One significant limitation of a sump pump is that it does not fully remove water, leaving the floor wet or damp. This limitation has the potential to extend water damage and facilitate mold growth. Even small amounts of standing water can seep into the floor and walls, weakening the structure over time and causing wood to rot or concrete to erode. This residual moisture creates an ideal environment for mold and mildew to flourish, which can lead to unpleasant odors, health issues, and the deterioration of indoor air quality.

Moreover, incomplete water removal can attract pests such as insects and rodents that seek out damp areas. This situation can become particularly problematic in spaces like basements or crawl spaces, where unchecked moisture can go unnoticed for extended periods, leading to extensive and costly damage.

Another limitation is the potential for the pump's sensors or switch mechanism to malfunction. If the pump does not activate until a certain water level is reached, or if it shuts off before all the water is removed, it may not be effective in preventing flooding or water damage during heavy rain or in high water table areas.

Finally, the continuous presence of water can also lead to premature corrosion and failure of the sump pump itself, as well as other mechanical and electrical systems in the area. This not only necessitates more frequent maintenance and replacement but also increases the risk of failure when the system is most needed.

For small boats, sump pumps are an essential device for managing water accumulation. They play a critical role in ensuring safety and operational efficiency. In the confined spaces of a small boat, water can accumulate rapidly due to various sources such as rain, waves splashing into the boat, or leaks from the hull or other onboard systems. This accumulation, if left unchecked, can lead to increased weight and instability, potentially causing the boat to sit lower in the water or, in extreme cases, to capsize. The sump pump generally addresses this issue by automatically detecting and removing excess water from the boat's bilge, which is the lowest compartment inside the hull. It is especially crucial in maintaining buoyancy and balance during harsh marine conditions when water ingress is more pronounced. Furthermore, in small boats, where space is at a premium and manual bailing is not always feasible or efficient, a sump pump offers a reliable and automatic solution to prevent water accumulation. By keeping the bilge dry, the pump not only helps maintain the structural integrity of the boat but also prevents the growth of mold and mildew, which can damage the boat's interior and equipment over time.

The need exists, therefore, for a sump pump system that addresses the deficiencies of the current designs and achieves the state of complete dryness of the surface that it is designed to protect.

SUMMARY

Accordingly, it is an object of the present invention to overcome these and other drawbacks of the prior art by providing a novel sump pump system configured to improve water removal from an area at risk for water accumulation.

It is another object of the present invention to provide a sump pump system configured for both water removal and air ventilation of the area prone for water accumulation.

It is a further object of the present invention to provide a method of removal of standing water capable of preventing residual amounts of water from remaining in place and reducing the risk of mold formation as a result thereof.

It is yet a further object of the present invention to provide methods of reducing the risk of water damage to the area prone to water accumulation.

The sump pump system of the invention includes a water intake port, a water accumulation reservoir, a water discharge pump, and a vacuum pump. The water accumulation reservoir, in turn, may include a first port, a second port in fluid communication with the water intake port and positioned above the first port, and a third port positioned above the second port. The water discharge pump may be assembled to be in fluid communication with the first port of the water accumulation reservoir. A water discharge port may also be provided to be in fluid communication with the water discharge pump and configured, upon activation thereof, to direct water to discharge from the water accumulation reservoir. The vacuum pump of the system may be fluidly attached to the third port and configured, when activated, to decrease air pressure in the water accumulation reservoir below atmospheric pressure. Once the pressure is reduced, the water is forced to flow from the water intake port through the second port into the water accumulation reservoir. When the vacuum pump is activated and no water is present, it causes air ventilation in the vicinity of the water intake port, which improves a state of dryness and eliminates any small amounts of water that may still be present.

Alternative configurations of the air pump and vacuum pump and connections/attachments thereof are also described.

One advantage of the present system is the periodic activation of the vacuum pump to cause air ventilation even if water is not detected to be present. This activation on a predetermined schedule assures a better state of dryness of the area prone to water accumulation, as compared to the present sump pump systems.

Novel methods of operating a sump pump system are also described and may include the following steps:

a. providing a sump pump system, which may include a water intake port and a water accumulation reservoir with three ports:
   i. a first port in fluid communication with a water discharge port,
   ii. a second port in fluid communication with the water intake port, wherein the second port is positioned above the first port, and
   iii. a third port in fluid communication with an air pump assembly, the third port positioned above the second port,
b. activating the air pump assembly on a periodic schedule basis to decrease air pressure in the water accumulation reservoir below atmospheric pressure. The presence of negative pressure causes water to flow from the water intake port through the second port into the water accumulation reservoir. Once all water is removed, negative pressure causes air ventilation in the vicinity of the water intake port, and
c. causing water to discharge from the water accumulation reservoir through the first port and through the water discharge port on a predetermined time schedule. This, in turn may be achieved by:
   i. activating a water discharge pump fluidly connected in line between the first port and the water discharge port, while venting the water accumulation reservoir to atmospheric pressure, or
   ii. activating the air pump assembly to increase air pressure in the water accumulation reservoir above atmospheric pressure.

In other embodiments, step (c) may further include a step of detecting a water level reaching a predetermined height above the second port and below the third port, followed by the step of causing water to discharge from the first port of the water accumulation reservoir.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF PREFERRED EMBODIMENTS OF THE INVENTION

Figure 1:
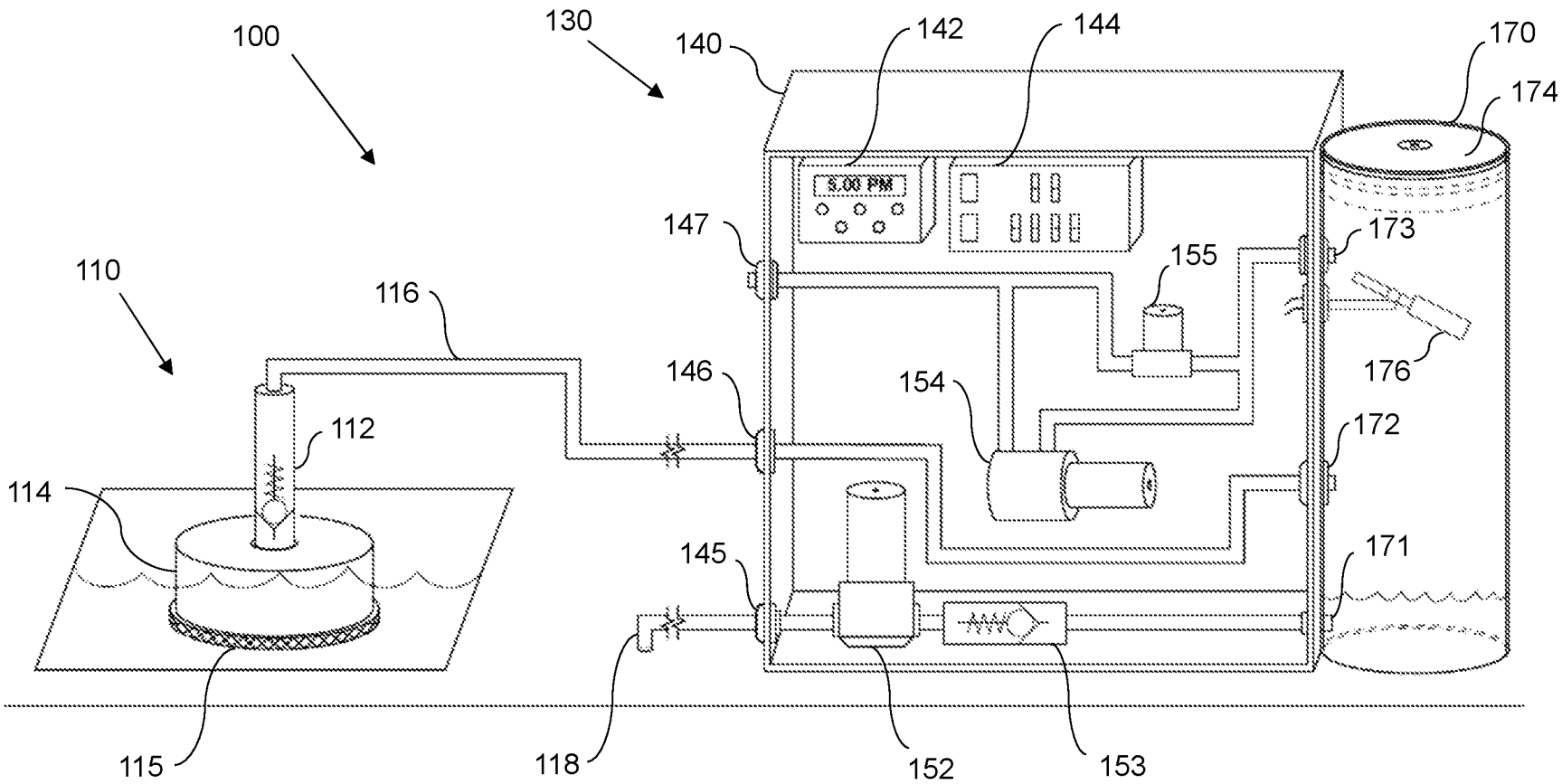
FIG. 1 is a general schematic view of the system of the present invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIG. 1 illustrates one exemplary embodiment of the sump pump system 100 of the present invention. In broad terms, system 100 may include a sump pump 130 attached to a water intake assembly 110. The water intake assembly 110 may be located closely or adjacent to the sump pump 130 or, in some cases, may be positioned remotely from the sump pump 130. When positioned at some distance from the sump pump 130, the water intake assembly may be fluidly connected to the sump pump 130 via a flexible hose 116. The flexible hose 116 may be selected to be kink-resistant and equipped with quick-connect couplings on one or both ends thereof. This may be advantageous to facilitate the replacement of the hose 116 and the repositioning of the water intake assembly 110 to a different spot in the area prone to flooding or water accumulation.

The water intake assembly 130 may include a water inlet positioned at the bottom of a weighted base 114 configured to maintain the water intake assembly 130 in a vertical or another preferred orientation, facilitating maximal water intake from the lowest point of the surface on which the weighted base 114 is located. The weight of the weighted base may be selected to be sufficient to keep the water intake assembly at the same position and orientation throughout the cycles of removing water and ventilating the surrounding area. In embodiments, the weight of the weighted base 114 may be selected to be from about 0.5 lbs to about 5 lbs, such as at least 0.5 lbs, at least 1 lb, at least 1.5 lbs, at least 2 lbs, at least 3 lbs, at least 4 lbs, or about 5 lbs. The size of the weighted base, such as its diameter in case of a round or cylindrical shape, or any of the dimensions of the width and length may be selected to assure a stable positioning of the water intake assembly on the surface underneath thereof. Exemplary sizes or diameters may be from about 2 inches to about 10 inches, such as at least 2 inches, at least 3 inches, at least 4 inches, at least 5 inches, at least 7 inches, or up to about 10 inches. In other embodiments, the size and the weight of the weighted base may be selected to be different from the above-mentioned examples, as may be dictated by specific circumstances of the use of the sump pump system 100 of the present invention.

Furthermore, the lower surface of the weighted base 114 may include a screen or mesh 115 as well as one or more grooves to facilitate water or air flow to proceed into the water intake assembly from the areas surrounding the weighted base 114. One suitable example of such an arrangement is a plurality of radial grooves leading to the center of the weighted base 114, where the water intake opening may be located. The screen 115 may be used to prevent large pieces of debris from entering the sump pump system of the present invention.

In further embodiments, the water intake assembly 110 may be secured to another item located in the target area for water removal, such as a piece or railing, a pipe, a bracket, etc., as a further method to secure the water intake assembly in place.

In embodiments, the water intake assembly 110 may include an optional water intake check valve 112 positioned in line with the water flow and configured to direct the flow of water or air only from the water intake assembly 110 toward the water accumulation reservoir 170. The check valve 112 may be selected to have any of the commonly used principles, such as a spring-loaded ball, a duck bill, or other check valve designs, as the invention is not limited in this regard. The presence of the water intake check valve 112 may help to prevent the backflow of water once the sump pump 130 is turned off.

The sump pump 130 may include a housing 140 equipped with a display and control panel 142 and an electronic controller 144. The display and control panel 142 may be configured to facilitate the programming of various timed events that would define the operational schedule for the sump pump 130. The display and control panel 142 may also be used to communicate various system states, indicate the presence or absence of electrical power, and for other utility purposes. The housing 140 may be made from water-resistant materials, such as plastic, metal, or composite materials.

The water accumulation reservoir 170 may be attached to or positioned within housing 140 and configured for vertical orientation so that multiple ports inside thereof maintain a vertical presence and relationship to each other, as described below. The water reservoir 170 may be made from water-resistant materials, similar to that of the housing 140. In embodiments, it may have a removable cover 174 that may be sealingly placed on top of the accumulation reservoir 170. The cover 174 may be provided to allow access and maintenance of the sensor component inside thereof and for other repair and maintenance purposes.

The water accumulation reservoir 170 may have a plurality of ports spaced apart vertically and arranged in the following manner: a first port 171, a second port 172, which may be in fluid communication with the water intake port 146, the second port 172 may be positioned above the first port 171, and a third port 173 positioned above the second port 172, and, of course, above the first port 171. The water accumulation reservoir 170 may be sealed and configured to not change its shape (such as by buckling or collapsing) when operational air pressure or vacuum levels are present inside thereof, as described below in greater detail. Vertical spacing of the ports may be adjusted based on the required volume and height of the water accumulation reservoir 170. In alternative embodiments, the first port 171 may be formed at or near the bottom of the water accumulation reservoir 170, while the third port 173 may be formed in or near the cover thereof.

A water level sensor 176 may be positioned above the second port 172 and below the third port 173 and configured to detect a water level reaching a predetermined height inside the water accumulation reservoir 170. Various types of water level sensors may be used for this purpose, including a floater-activated sensor, an electrically activated sensor, and other sensors, as the invention is not limited in this regard.

In further embodiments, the water accumulation reservoir 170 may have a side observation window at or along the outside portion of the external wall to facilitate understanding of the water level inside thereof.

The remaining parts of the sump pump 130 are now described with reference to FIG. 1. The housing 140 may have a water intake port 146, a water discharge port 145, and an air vent port 147. The water intake port 146 may be fluidly connected to the second port 172 of the water accumulation reservoir 170. In embodiments, the water intake port 146 and/or the water discharge port 145 may include a connection fitting configured to allow rapid disconnect of the hoses and tubing attached thereto and replacement thereof. The water discharge port 145 may be fluidly connected to the water discharge outlet 118, which may be routed to a suitable drain that may be selected to be capable of accepting the expected volume of water from the water accumulation reservoir 170. In the case of using the sump pump system 100 on a boat, a simple water discharge overboard may be sufficient for this purpose. In other situations, a collection volume for accepting discharged water may be provided, for example, in circumstances where discharge overboard is not allowed.

A vacuum pump 154 may be placed in the line between the air vent port 147 and the third port 173 of the water accumulation reservoir 170. The vacuum pump 154 may be electrically connected to the controller 144 to activate and deactivate thereof based on the signals from the controller 144. When the vacuum pump is activated by the controller 144, air is withdrawn from the water accumulation reservoir 170. This action causes a decrease in air pressure inside the water accumulation reservoir 170 below atmospheric pressure. If water is present around the water intake assembly 110, low air pressure may be sufficient to urge water to flow from the water intake assembly 110 through the second port 172 and into the water accumulation reservoir 170. If no water is present, the same action would cause air to flow through the same water intake pathway, which causes air ventilation in the vicinity of the water intake assembly 110.

Depending on the design of the vacuum pump 154, turning it off may cause the line between the air vent port 147 and the third port 173 to be sealed. To allow air venting of the water accumulation reservoir 170 during the water discharge part of its operation (as described below in greater detail), an electrically activated valve 155 may be positioned in parallel to the vacuum pump 154. This may be the case when a diaphragm pump is used as a vacuum pump 154. In other cases, when turning off the vacuum pump 154 does not seal the line to the air vent port 147 off, there may be no need for the presence of the electrically activated valve 155 in the sump pump 130. This may be the case when a centrifugal or another rotary air pump is used as the vacuum pump 154.

The remaining portion of the sump pump 130 is the water discharge line connecting the first port 171 of the water accumulation reservoir 170 to the water discharge port 145. A water discharge pump 152 may be placed to have its inlet in fluid communication with the first port 171 of the water accumulation reservoir 170. The outlet of the water discharge pump 152 may be configured to direct water flow to the water discharge port 145. Depending on the type of water discharge pump 152, a check valve 153 may be placed in the water discharge line to prevent the backflow of water into the water accumulation reservoir 170. This may be the case when a rotary pump is used as a water discharge pump 152. The check valve assures that no water or air would flow back into the water accumulation reservoir when the air pressure inside thereof is below atmospheric pressure. In case the water discharge pump 152 is selected to be able to seal off the water discharge line when it is not in use, there may be no need for the check valve 153 if there is no backflow expected to pass through the water discharge pump 152.

The controller 144 may be operatively connected to the water level sensor 176, the water discharge pump 152, the vacuum pump 154, and the electrically activated valve 155. Controller 144 may be programmed or otherwise configured to activate the vacuum pump 154 on a predetermined time schedule. In some embodiments, the controller 144 may be configured for a wireless Internet connection or a wireless local connection to a secondary control panel. In this case, the operation and programming of controller 144 may be done remotely, for example, using a corresponding smartphone app, as the invention is not limited in this regard.

Figure 2:
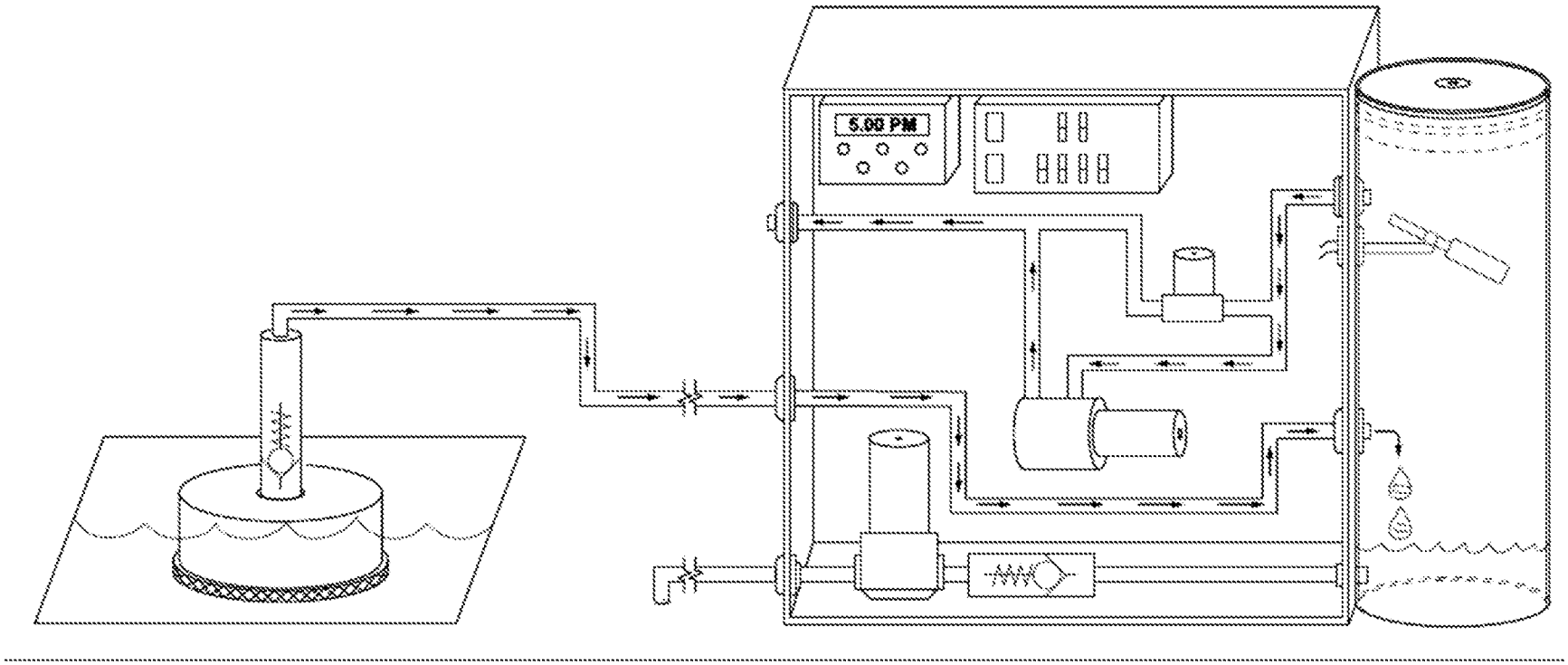
FIG. 2 is a general diagram of the same showing the state of water intake.

Activation of the vacuum pump 154 (see FIG. 2) may lead to a decrease in air pressure in the water accumulation reservoir 170, thereby causing either (i) water to flow from the water intake assembly 110 through the second port 172 into the water accumulation reservoir 170, or (ii) air ventilation in the vicinity of the water intake assembly 110. The timing of the beginning and end of the vacuum pump 154 activations may be set using the display and control panel 142. In one example, the vacuum pump may be turned ON once or twice per day for a duration of 5 to 10 minutes. Other suitable schedules may be programmed into controller 144 depending on the specific circumstances of the use of the sump pump system 110 of the present invention.

Figure 3:
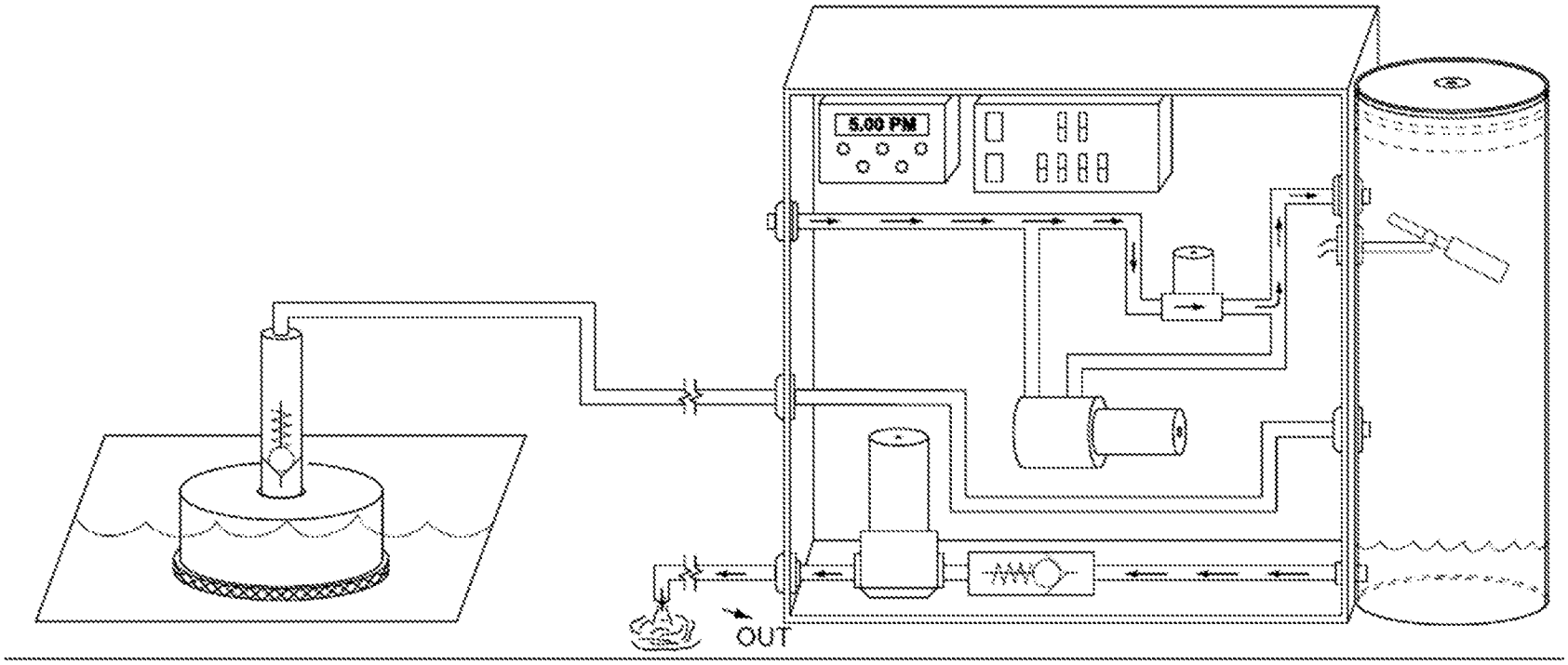
FIG. 3 is a general diagram of the same showing the state of water discharge.

The controller 144 may be further configured to activate the water discharge pump 152 upon the water level sensor 176 detecting the water level reaching the predetermined height above the second port 172 and below the third port 173 therein, thereby causing water to be discharged from the water accumulation reservoir 170—see FIG. 3.

In some embodiments of this invention, while the activation of the vacuum pump 154 may be conducted on a timed basis, the activation of the water discharge pump 152 may be conducted only upon detection of the presence of a sufficient volume of water in the water accumulation reservoir 170 to trigger activation of the water level sensor. This arrangement is done for the purposes of not only removing water present in the vicinity of the water intake assembly 110, but also for ventilation of that area once all water is removed therefrom.

In further embodiments, additional activation of the vacuum pump 154 may be conducted on top of the timed activations as described above, for example, as triggered by additional water sensors located at or near the water intake assembly 110. These additional activations may be helpful to cause immediate water removal to avoid awaiting the next scheduled time when the vacuum pump 154 is to be activated. Such additional sensors may include conventional water sensors, as well as a video camera adapted to detect water presence in the area of observation and in the vicinity of the water intake assembly 110.

In further embodiments, activation of the water discharge pump 152 may either precede and/or conclude at least some or all occasions of operating the water intake components of the sump pump system of the invention. in this case, the water discharge pump 152 may be turned on for a predetermined amount of time selected to match or exceed the duration of time needed for the water discharge pump 152 to empty the entire water accumulation reservoir 170. This approach may be used to ensure that all water that may partially or fully fill the water accumulation reservoir 170 during a preceding cycle of operating the water intake part of the system is discharged before more water is urged to fill the water accumulation reservoir 170.

In further embodiments, controller 144 may be configured or programmed to initiate the action of reducing the air pressure in the water accumulation reservoir 170 for a predetermined period of time, which may be selected to match or exceed the duration needed to fill the entire water accumulation 170 with water. If the water level sensor is not triggered to indicate the water level reaching the top of the water accumulation reservoir 170, the vacuum pump may be stopped, as there is no more water to be evacuated into the water accumulation reservoir 170. If the water sensor is triggered to indicate the water level has reached the top of the water accumulation reservoir 170, the vacuum pump 154 may also be stopped, the water discharge pump 152 may be activated for the duration of time needed to fully discharge all the water from the water accumulation reservoir 170, and the vacuum pump 154 may be activated again to continue evacuating water from the water inlet assembly 110. These cycles may continue until the water level sensor 176 is no longer triggered by the presence of water-indicating that there is no more water available to evacuate from the vicinity of the water intake assembly 110.

Figure 4:
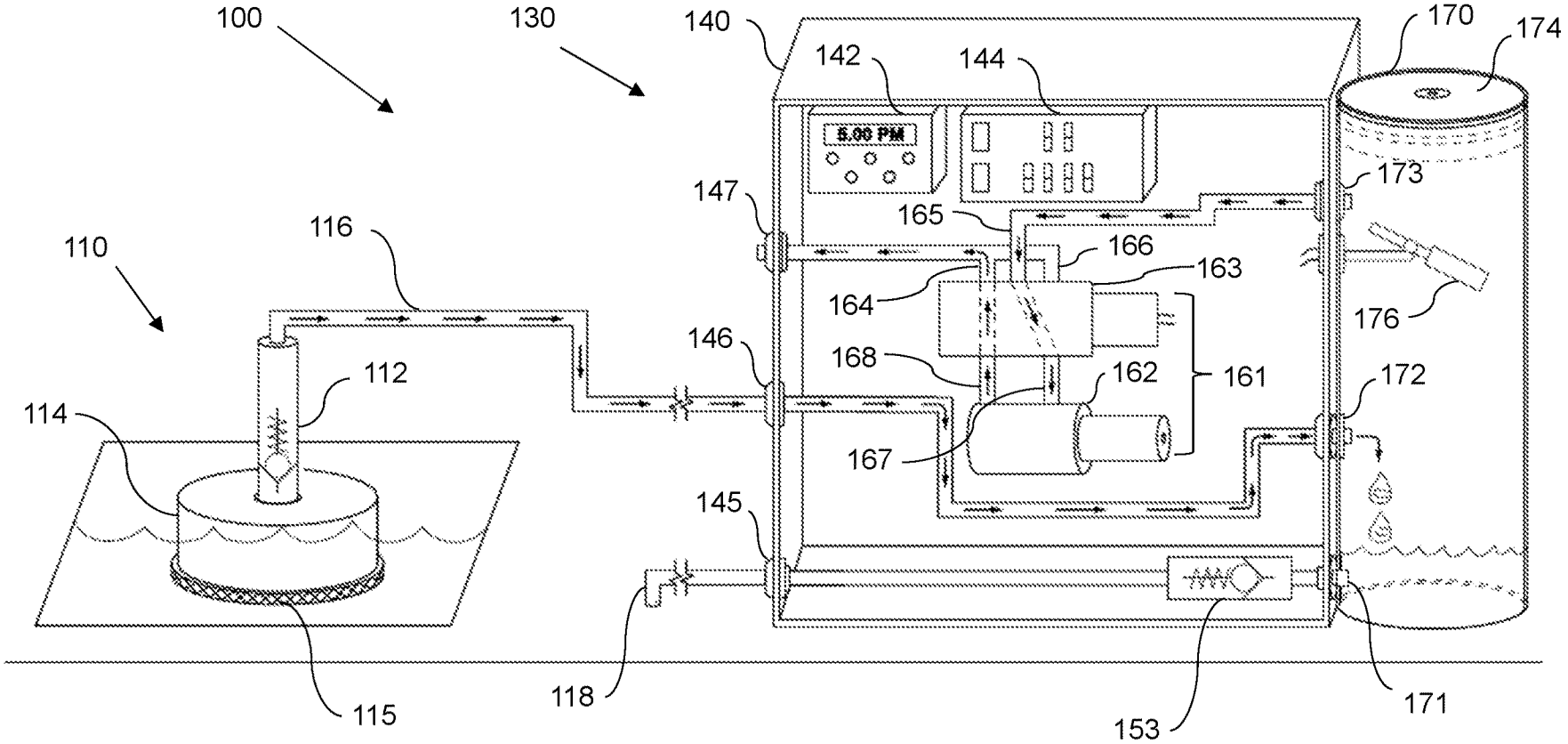
FIG. 4 is a general diagram of the an alternative system configuration showing the state of water intake.
Figure 5:
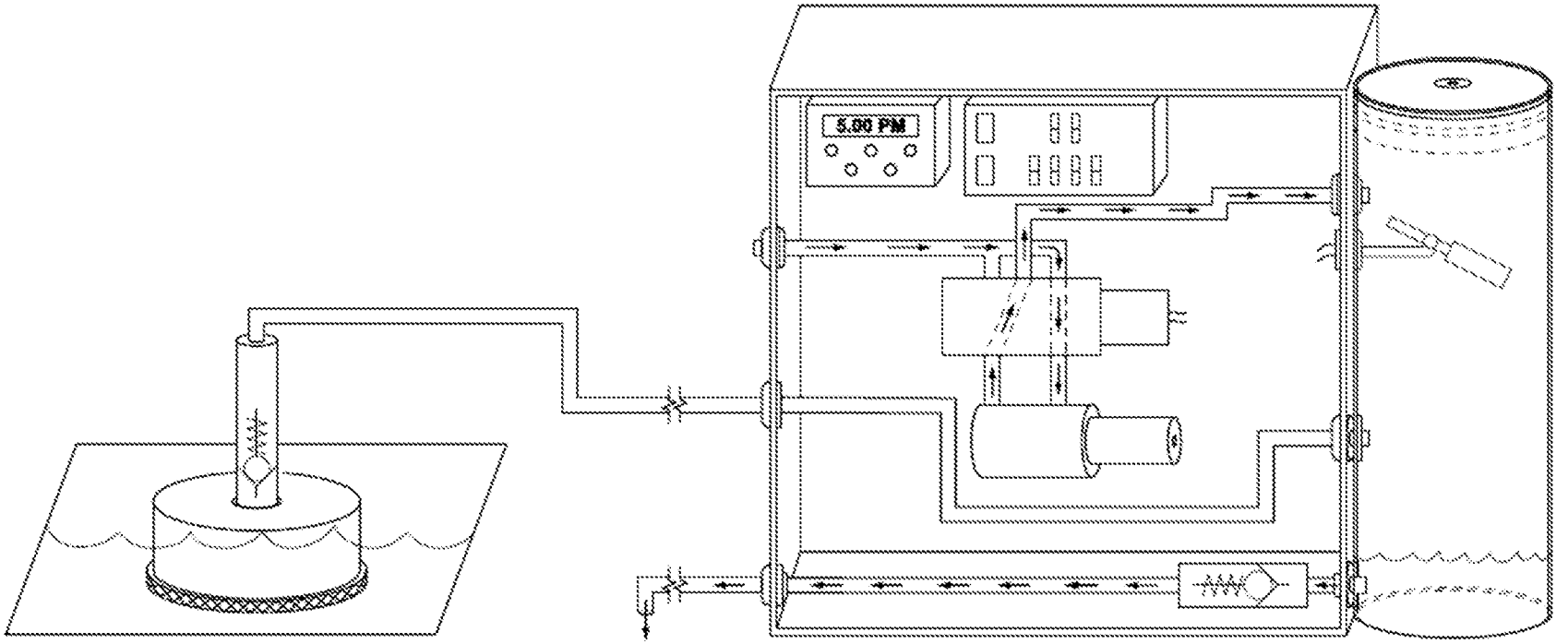
FIG. 5 is a general diagram of the same as in FIG. 4 showing the state of water discharge.

FIGS. 4 and 5 show an alternative configuration of the sump pump 130. It may include the water intake port 146 configured to direct water to flow only toward the sump pump system 130. The water accumulation reservoir 170 is also provided with the first port 171, the second port 172, in fluid communication with the water intake port 146, wherein the second port 172 is positioned above the first port 171. Also provided is the third port 173 positioned above the second port 172, and a water level sensor 176 configured to detect a water level reaching a predetermined height above the second port 172 and below the third port 173. The water discharge port 145 is in fluid communication with the first port 171 of the water accumulation reservoir 170.

In an alternative to the design of the sump pump described above, this design may include an air vacuum/compressor pump assembly 161 positioned to be in fluid communication with the third port 173. The air vacuum/compressor pump assembly 161 may include an air vacuum/compressor pump 162 and a valve assembly 163 configured to alternate the direction of airflow from the air vacuum/compressor pump 162 between a first direction INTO the water accumulation reservoir 170 and a second direction FROM the water accumulation reservoir 170. The valve assembly 161 may include a 4-way valve or include two or more simpler 2-way valves, as the invention is not limited in this regard. When air is pumped into the water accumulation reservoir 170, the air pressure inside thereof is increased to a level above atmospheric pressure. When the air is pumped out of the water accumulation 170, the air pressure inside thereof is decreased below the ambient or atmospheric pressure.

This reverse functionality may be accomplished, in one example, by providing the air vacuum/compressor pump 162 defining an air inlet 167 and an air outlet 168, wherein the valve assembly 163 may be configured to alternate the connection of the air inlet 167 or the air outlet 168 to the third port 173 of the water accumulation reservoir 170 to correspondingly alternate the direction of airflow from and to the water accumulation reservoir 170.

Upon activation by the controller 144, the air vacuum/compressor pump assembly 161 may, in one case, decrease air pressure in the water accumulation reservoir 170 below atmospheric pressure to cause water to flow from the water intake port 146 through the second port 172 and into the water accumulation reservoir 170, or to cause air ventilation in a vicinity of the water intake assembly 110—see FIG. 4. In this case, the air inlet 167 is connected by the valve assembly 163 to the port 165, which in turn is connected to the third port 173 of the water accumulation reservoir 170. At the same time, air outlet 168 is attached to port 164, leading the airflow toward the air vent port 147.

The reverse operation is seen in FIG. 5, where the air vacuum/compressor pump assembly 161 is operated by the controller 144 to increase air pressure in the water accumulation reservoir 170 above atmospheric pressure, which causes water to discharge from the water accumulation reservoir 170 through the first port 171 and through the water discharge port 145.

One advantage of this configuration is that the water discharge pump no longer needs to be present, as both water intake into and water discharge from the water accumulation reservoir 170 is done by changing the air pressure inside thereof.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A sump pump system comprising:

a water intake port configured to direct water to flow only toward the sump pump system, a water accumulation reservoir comprising a first port located adjacent a lower end of the reservoir, a second port located above the first port, the second port being in fluid communication with the water intake port, and a third port located above the second port, wherein the first, second, and third ports are distinct from one another and are positioned in series along a side wall of the reservoir so that the interior volume of the reservoir communicates with an exterior of the reservoir only through the first, second, and third ports, a water discharge port in fluid communication with the first port of the water accumulation reservoir, the water discharge port located outside the water accumulation reservoir, a vacuum/compressor system in fluid communication with the third port and configured, when operated in a vacuum mode, to decrease air pressure in the water accumulation reservoir below atmospheric pressure to cause water or air to flow from the water intake port through the second port into the water accumulation reservoir, and when operated in a pressure mode, to increase air pressure in the water accumulation reservoir above atmospheric pressure to cause water to discharge from the first port and through the water discharge port, a water level sensor configured to detect a water level reaching a predetermined height above the second port and below the third port, a controller operatively connected to the vacuum/compressor system, and the water level sensor, the controller being configured to operate the vacuum/compressor system alternately in the vacuum mode and the pressure mode and not to operate vacuum and pressure functions simultaneously, to activate and deactivate the vacuum/compressor system in the vacuum mode on a predetermined time schedule without user intervention so as to periodically turn the sump pump system on and off, and to activate the vacuum/compressor system in the pressure mode when the water level sensor detects that the water level has reached the predetermined height, and a water intake assembly positioned remotely from the water accumulation reservoir and connected to the water intake port by a flexible hose, the water intake assembly comprising a weighted base, a water inlet in the weighted base configured to rest adjacent a lowest point of a surface to be drained, and a water intake check valve arranged between the water inlet and the flexible hose and configured to allow flow only toward the water accumulation reservoir, wherein periodic activation and deactivation of the vacuum/compressor system, while in the vacuum mode, aspirates water from the water inlet into the water accumulation reservoir, followed by air ventilation to achieve dryness of:

(i) the water intake assembly and the flexible hose connecting thereof to the water intake port, and (ii) the surface to be drained around the water inlet of the water intake assembly.

2. The sump pump system, as in claim 1, wherein the air vacuum/compressor pump assembly comprises an air vacuum/compressor pump and a valve assembly configured to alternate direction of airflow from the air vacuum/compressor pump between a first direction into the water accumulation reservoir to increase air pressure therein and a second direction from the water accumulation reservoir to decrease air pressure therein.

3. The sump pump system, as in claim 2, wherein the air vacuum/compressor pump comprises an air inlet and an air outlet, wherein the valve assembly is configured to alternate the connection of the air inlet or the air outlet to the third port of the water accumulation reservoir to correspondingly alternate the direction of airflow from and to the water accumulation reservoir.

4. The sump pump system, as in claim 2, wherein the valve assembly is a 4-way valve.

5. A method of operating a sump pump system comprising the following steps:

a. providing a sump pump system comprising a water intake port, a water accumulation reservoir with a first port located adjacent a lower end of the reservoir, a second port located above the first port in fluid communication with the water intake port, and a third port located above the second port, wherein the first, second, and third ports are distinct from one another and are positioned in series along a side wall of the reservoir so that the interior volume of the reservoir communicates with an exterior of the reservoir only through the first, second, and third ports, a water discharge port in fluid communication with the first port of the water accumulation reservoir, a vacuum/compressor system in fluid communication with the third port and configured to operate in a vacuum mode and a pressure mode, a water level sensor configured to detect a water level reaching a predetermined height above the second port and below the third port, a controller operatively connected to the vacuum/compressor system and the water level sensor, the controller being configured to operate the vacuum/compressor system alternately in the vacuum mode and the pressure mode and not to operate the vacuum mode and the pressure mode simultaneously, and to activate and deactivate the vacuum/compressor system on a predetermined time schedule without user intervention so as to periodically turn the sump pump system on and off, a water intake assembly positioned remotely from the water accumulation reservoir and connected to the water intake port by a flexible hose, the water intake assembly comprising a water inlet configured to rest on a surface to be drained, b. activating the vacuum/compressor system in the vacuum mode on a periodic schedule basis to decrease air pressure in the water accumulation reservoir below atmospheric pressure to cause water to flow from the water intake port through the second port into the water accumulation reservoir, or to cause air ventilation through the water inlet, the flexible hose, and in the vicinity of the water intake port to achieve dryness of (i) the water intake assembly and the flexible hose connecting thereof to the water intake port, and (ii) the surface to be drained around the water inlet of the water intake assembly, and c. causing water to discharge from the water accumulation reservoir through the first port and through the water discharge port when the water level sensor detects that the water level has reached the predetermined height by increasing air pressure in the water accumulation reservoir using the vacuum/compressor system in the pressure mode, and then stopping operation of the sump pump system until a next activation ii.

* * * * *